US005178341A

United States Patent [19]

Ditto

[11] Patent Number: 5,178,341

[45] Date of Patent: Jan. 12, 1993

[54] WINDER SPEED CONTROL APPARATUS

[75] Inventor: James W. Ditto, Golden, Colo.

[73] Assignee: Graphic Packaging Corporation, Paoli, Pa.

[21] Appl. No.: 887,158

[22] Filed: May 21, 1992

Related U.S. Application Data

[63] Continuation of Ser. No. 552,439, Jul. 13, 1990, abandoned.

[51] Int. Cl.[5] ..... B65H 23/08

[52] U.S. Cl. ..... 242/75.51; 318/6

[58] Field of Search ..... 242/75.51, 75.44, 190; 226/44; 318/6, 7

[56] References Cited

U.S. PATENT DOCUMENTS

| | | | |
|---|---|---|---|
| 2,605,101 | 7/1952 | Lessmann | 318/6 |
| 2,904,275 | 9/1959 | Selsted et al. | 242/190 |
| 3,045,937 | 7/1962 | Johnson | 242/75.51 X |
| 3,441,825 | 4/1969 | Dinger | 318/6 |
| 3,713,009 | 1/1973 | Poppinger et al. | 242/75.51 X |
| 3,829,748 | 8/1974 | Davenport | 242/75.51 X |
| 3,936,008 | 2/1976 | Crum | 242/75.51 X |
| 4,359,178 | 11/1982 | Hayashi et al. | 226/44 X |
| 4,407,331 | 10/1983 | Rehling et al. | 242/75.51 X |
| 4,708,301 | 11/1987 | Kataoka | 226/44 X |
| 4,775,086 | 10/1988 | Kataoka | 242/75.51 X |
| 4,848,630 | 7/1989 | Niestrath et al. . | |
| 4,896,808 | 1/1990 | Bolza-Schunemann et al. . | |
| 4,997,120 | 3/1991 | Tanaka et al. . | |

FOREIGN PATENT DOCUMENTS

| | | | |
|---|---|---|---|
| 0489062 | 11/1976 | Australia | 226/44 |
| 760713 | 7/1976 | Canada | 226/44 |

*Primary Examiner*—Daniel P. Stodola
*Assistant Examiner*—John F. Rollins
*Attorney, Agent, or Firm*—Klaas, Law, O'Meara & Malkin

[57] ABSTRACT

A speed control assembly for a rotatable web winding apparatus comprising a dancer engaged with a web of material wound about the winder apparatus for displaceably responding within a predetermined range of dancer positions to tension variations in the web; a first control signal generating device for generating a first control signal in response to dancer displacement from a predetermined centered position, the ratio of dancer displacement to the first control signal being variable over the range of dancer displacement positions; and a dancer response rotation control device for rotationally accelerating the winding apparatus in response to the first control signal.

18 Claims, 2 Drawing Sheets

WINDER SPEED CONTROL APPARATUS

This application is a continuation of application Ser. No. 552,439, filed July, 13, 1990, now abandoned.

BACKGROUND OF THE INVENTION

The present invention relates generally to web processing apparatus and, more particularly, to a speed control assembly for a web winder.

continuous web processing apparatus such as web printers generally include a web "unwind" or "supply" spool from which unprocessed web material is supplied and a web "rewind" or "windup" or "collection" spool upon which the processed web is collected. Each of these spools is typically mounted upon a separate, driven, winder apparatus which rotates the spool mounted thereon at a selected rate. As the diameter of the web wound about a spool changes, the rotational velocity of the spool must also change if a constant web supply or collection rate is to be maintained. The rotation rate of the web winding apparatus must also be adjusted to accommodate for speed fluctuations at various web processing operating stations which are positioned along the web between the unwind and rewind spools. The most common method for maintaining proper winder speed is through use of a dancer assembly. A dancer assembly is a device consisting of at least one idler roll which is positioned in contact with the web of material. The dancer roll is displaceable in a direction transverse to the direction of web movement and is biased in a direction which opposes the tension applied to the dancer roll by the web. The bias force is of a magnitude such that when the web processing machine is operating at its normal web tensions, the dancer is positioned near the center of its range of movement. If the speed of the web varies with respect to the speed of the associated winder in a manner which decreases web tension, the dancer is displaced by the bias force in a direction to take up the resulting "slack" in the web. If the operation of the associated winder with respect to web line speed is such that the tension in the web increases, the dancer is displaced by the web tension force in a direction which shortens the web path and reduces web tension.

Winder speed is controlled by varying the speed of the winder in response to the displacement of the associated dancer assembly.

Various methods of processing a dancer displacement signal to control winder speed are known in the prior art. One method, known as 100% proportional control, is illustrated in FIG. 1. In this method of control, the winder motor velocity is increased or decreased as a linear function of dancer displacement from a dancer position near one end of the dancer travel path. The winder velocity to dancer position relationship for a supply winder is indicated in solid lines. The winder velocity to dancer position relationship for a collection winder having a dancer assembly identical to that for the supply winder is indicated in dashed lines. In such a system, at one end of the dancer travel range the winder operates at full speed, and at the other end of the dancer travel range the winder stops. Typically, the range of dancer displacement is selected to be somewhat larger than the range of dancer displacement needed to compensate for changes in roll diameter in order to accommodate other transient fluctuations in web speed. Such 100% proportional speed control results in a system which is very responsive but difficult to stabilize. In situations where the web being processed is an extensible web such as plastic film, a 100% proportional control system becomes totally unstable and unusable.

In a variation of the 100% proportional control method illustrated in FIG. 1, the dancer displacement signal is used in the same manner to control web speed. However, it accounts for only a small portion, e.g. 10%, of the total winder velocity control signal. The remainder of the signal is a line speed reference signal produced by a web speed monitor positioned along the web at a point intermediate the unwind and rewind assemblies. In such a control scheme, the dancer is relatively unresponsive and thus the system is easy to stabilize for stead-state conditions. However, in such a scheme, the dancer typically runs off-center some amount to compensate for calibration error or web stretch. This type of system experiences trouble with major tension variations in the web and will reach a mechanical limit for correction due to the dancer's lack of responsiveness.

In another method of winder speed control, the winder is provided with a tachometer which provides a speed signal. This winder speed signal and a web line speed signal are provided to a computer and used to compute the associated winder spool web diameter. A base winder speed is then calculated by dividing line speed by winder spool web diameter. The calculated winder speed is thereafter trimmed with a velocity signal calculated as a linear function of dancer displacement such as illustrated in FIG. 1. Such systems are quite expensive and require factory technicians for accurate calibration and setup.

Another method of winder speed control is known in the art as 100% integrated dancer centering speed control. According to this method, an analog integrator receives an input representative of linear dancer displacement and a winder acceleration (as opposed to velocity) signal is calculated which is linearly proportional to the dancer displacement signal. In such a system, the dancer under normal operating conditions remains at the center of its displacement range. However, it is generally difficult to find a balance between stability and responsiveness for such a control system. A graph indicative of winder motor acceleration response to dancer displacement for such a system is illustrated in FIG. 2.

In a variation on the 100% integrated dancer centering control system illustrated in FIG. 2, a signal identical to that illustrated in FIG. 2 is initially provided. However, the control system rather than using this signal as a motor acceleration signal instead uses it as a spool diameter signal and the winder velocity signal is provided by dividing web line speed by this diameter signal. Such systems generally require a factory technical for setup. Such systems are subject to failure due to calibration shifts and also experience stability problems.

SUMMARY OF THE INVENTION

The present invention may comprise a speed control assembly for a rotatable web winding apparatus comprising: dancer means engaged with a web of material wound about said winder apparatus for displaceably responding within a predetermined range of dancer positions to tension variations in said web; first control signal generating means for generating a first control signal in response to dancer means displacement from a predetermined centered position, the ratio of dancer displacement to said first control signal being variable over said range of dancer displacement positions; and dancer response rotation control means for rotationally accelerating said winding apparatus in response to said first control signal.

The invention may also comprise a speed control assembly for a rotatable web winding apparatus comprising dancer means engaging with a web of material wound about said winder apparatus for displaceably responding within a predetermined range of dancer positions to tension variations in said web; first control signal generating means for generating a first control signal in response to dancer means displacement from a predetermined centered position, the ratio of dancer displacement to said first control signal being variable over said range of dancer displacement positions; dancer response rotation control means for rotationally accelerating said winding apparatus in response to said first control signal; wherein said dancer means comprises a dancer signal generating means for generating a dancer signal which is proportionate to the amount of displacement of said dancer means from said predetermined centered position and wherein said first control signal generating means processes said dancer signal to generate said first control signal; wherein said first control signal changes relatively slowly in response to dancer displacement within a first range of dancer positions which includes said predetermined centered position and wherein said first control signal changes relatively more rapidly in response to dancer displacement within a second range of dancer positions lying outside of said first range of positions; wherein said first control signal changes relatively most quickly in response to dancer displacement in a third range of dancer positions lying outside of said second range of positions; wherein the ratio of said first control signal to said dancer signal is a first constant value when said dancer mean is positioned within said first range of dancer positions; wherein the ratio of said first control signal to said dancer signal is a second constant value greater than said first constant value when said dancer means is positioned within said second range of dancer positions; wherein the ratio of said first control signal to said dancer signal is a third constant value greater than said second constant value when said dancer means is positioned within said third range of dancer positions; wherein said dancer response rotation control means comprises: motor means drivingly linked to said winding apparatus for rotating said winding apparatus; motor control means for controlling the speed of said motor means in response to a motor speed control signal; and speed control signal generating for receiving said first control signal and for generating said motor speed control signal in response thereto; web speed monitoring means for measuring web speed at a position on the web which is more remote from said web winding apparatus than the position of said dancer means and for generating a web speed signal indicative of said measurement; web speed response rotation control mean for receiving said web speed signal and for rotationally accelerating said winding apparatus by an amount dependent upon said web speed signal; whereby total winding apparatus acceleration is dependent upon web tension at said dancer means and web speed at said web speed monitoring means.

The invention may also comprise a method of controlling the rotational speed of a web winding apparatus comprising: monitoring the displacement of a web dancer from a predetermined dancer position; generating a first control signal which is a predetermined nonlinear function of dancer displacement over a predetermined range of dancer displacement position; accelerating said web winding apparatus in response to said first control signal.

BRIEF DESCRIPTION OF THE DRAWINGS

An illustrative and presently preferred embodiment of the invention is shown in the accompanying drawings in which.

DETAILED DESCRIPTION OF THE INVENTION

Figure 3:
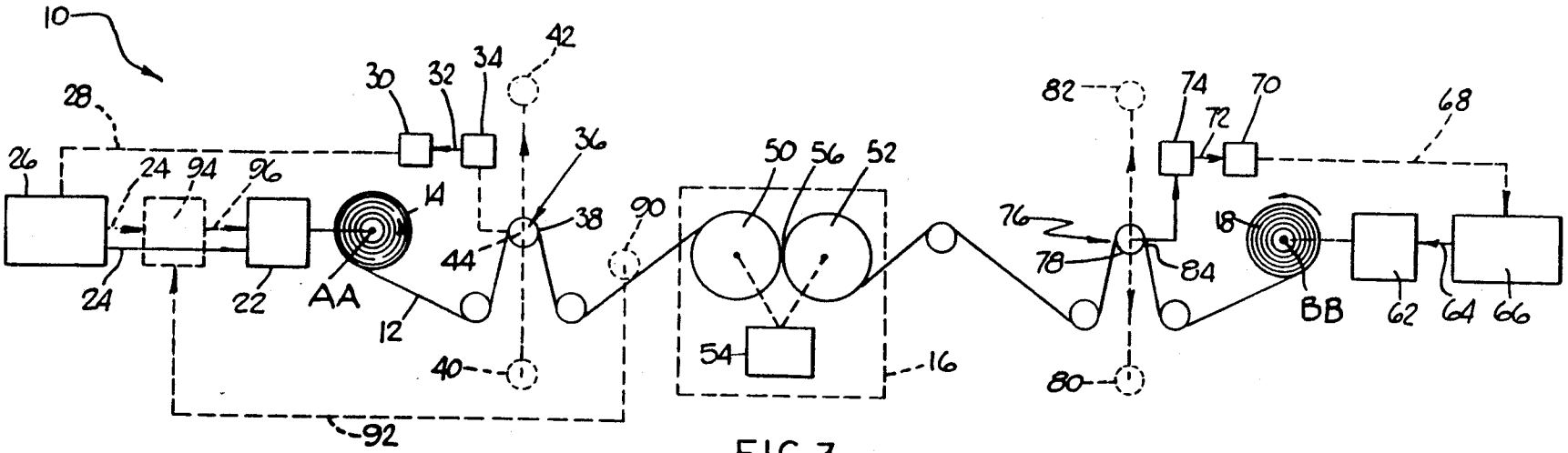
FIG. 3 is a schematic elevation view of a web processing system.
Figure 2:
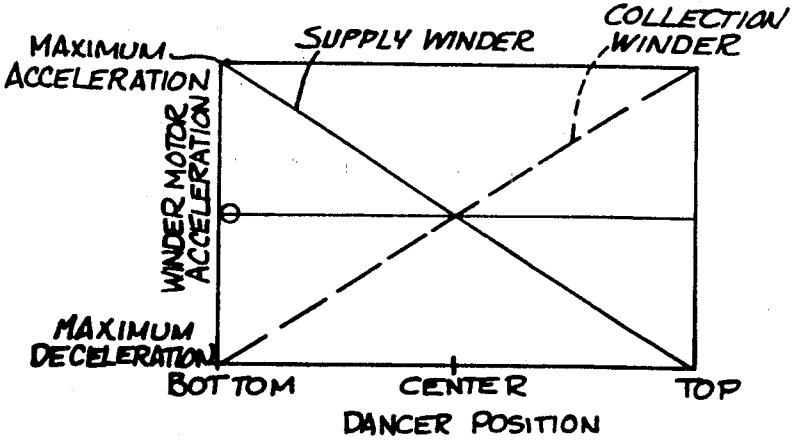
FIG. 2 (PRIOR ART)
FIG. 2 is a graph illustrating the relationship between dancer position and winder motor acceleration in a second prior art method of web winder control.
Figure 1:
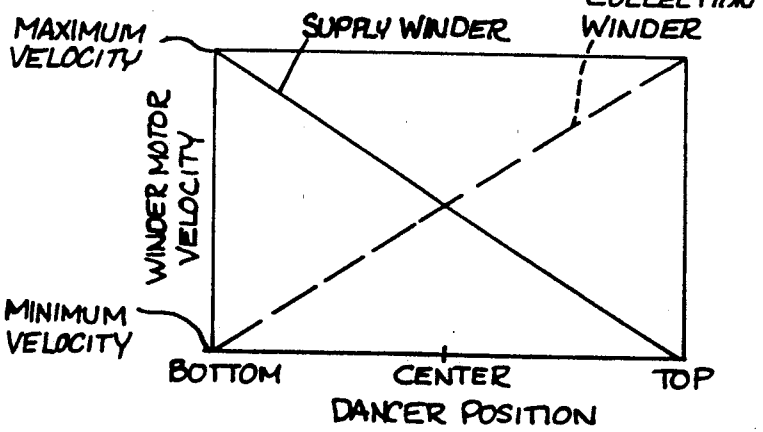
FIG. 1 (PRIOR ART)
FIG. 1 is a graph illustrating the relationship between dancer position and winder motor velocity in one prior art method of winder control.

FIG. 3 is a schematic illustration of a web processing apparatus 10 such as a web printer. A continuous web of material 12 is unwound from a supply roll 14 (also referred to as an unwind spool), processed at one or more processing stations 16 located downstream from the supply roll 14, and collected on a web rewind spool 18 (also referred to as a collection spool or a windup spool).

The unwind spool 14 is rotated about an axis AA by a direct current (DC) drive motor 22 which rotates spool 14 at a rotation rate which is directly proportional to the drive motor rotation rate. The drive motor 22 operates at a velocity which is directly proportional to a velocity command signal 24 which it receives from speed control assembly 26.

Speed control assembly 26 generates velocity control signal 24 by integrating a motor acceleration signal 28 which it receives from nonlinear dancer response circuit 30.

Nonlinear dancer response circuit 30 calculates control signal 28 from a dancer signal 32 generated by dancer displacement sensing device 34. Dancer signal 32 is directly proportional to the displacement of dancer 36.

Dancer 36 includes an idler roll 38, engaged by web 12, which is displaceable between a lowermost position 40 and an uppermost position 42. The dancer roll is biased toward position 40 by a conventional biasing device (not shown) of the type adapted to provide a biasing force which is constant over the displacement of the dancer from position 40 to 42. The biasing force is selected which corresponds to the normal tension setting of the web processing apparatus. Thus, if web velocity downstream of dancer assembly 36 becomes greater than the surface velocity of the web on spool 14, dancer roll 38 is displaced downwardly, and if web downstream velocity falls below that of the surface velocity of the web on spool 14, dancer 38 is displaced upwardly.

Web processing stations illustrated generally at 16 may comprise a pair of nip rolls 50, 52, which are driven at a relatively constant rate by a nip motor 54. In a typical processing operation, continuous web 12 is provided with a repeating set of web graphics at a printing nip 56 provided by rolls 50, 52.

Downstream of the web processing station 16, rewind spool 18 collects the processed web. Rewind spool 18 is rotated about axis BB by a DC drive motor 62 which drives spool 18 at a rate proportional to the drive motor rotation rate. Drive motor 62 rotates spool 18 at a rate which is linear proportionate to its own rotation rate. DC motor 62 receives a speed control command 64 from a control circuit 66 which integrates an acceleration command 68 which is generated by nonlinear dancer response circuit 70. Dancer response circuit 70 receives a dancer displacement command 72 from a dancer displacement signal generating device 74 which generates a signal that is linearly proportionate to the displacement of dancer 76. Dancer 76 comprises an idler roll 78 which is displaceable between positions 80, 82 and which as a centered position 84. Dancers 36, 76 may be of identical construction and may be of a type which are commercially available and well-known in the art such as, for example, Model No. L10075966 of Winder Assembly Model 192, Se. No. 27087-02 manufactured by Gloucester Engineering Company having a business mailing address of P.O. Box 900, Gloucester, Mass. 01930. Dancer displacement signal generating means 34, 74 may also be of a type well-known in the art such as those sold as a unit with the above-referenced commercially available dancers.

Figure 4:
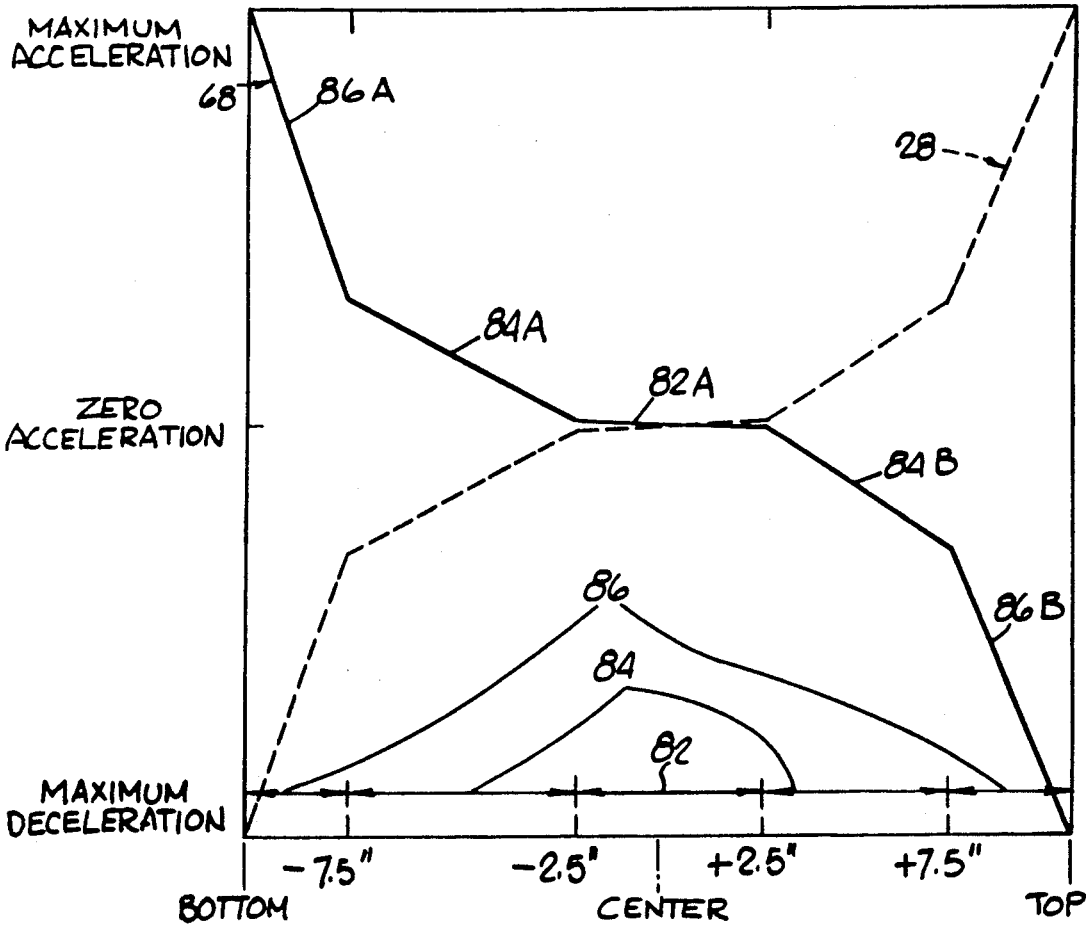
FIG. 4 is a graph illustrating the relationship between dancer position and winder motor acceleration for web winders used in the web processing assembly of FIG. 3.

A graph showing the value of signal 28 and 68 as the vertical axis and showing the relative dancer displacement from a center position as the horizontal axis in a typical dancer winder configuration is illustrated in FIG. 4. The graph of signal 68 is indicated in solid lines, and the graph of signal 28 is illustrated in dashed lines. As shown by FIG. 4, motor acceleration signal 68 comprises a relatively flat response in a central portion 82 of the dancer range of motion, a relatively larger response in an intermediate portion 84, and a relatively highest response in an exterior portion 86. In the illustrated embodiment, in the central region 82 of dancer motion acceleration signal 68 comprises a straight line 82A. In intermediate region 84, signal 68 may comprise straight lines 84A, 84B of the same or slightly different slope steeper than the slope of 82A. In the exterior response region 86, signal 68 may also comprises two straight lines 86A, 86B of the same of slightly different slope steeper than the slopes of 84A of 84B. A response characteristic such as that illustrated in FIG. 4 provides a system which is extremely stable and yet also capable of providing relatively high-rate response when necessary.

Figure 5:
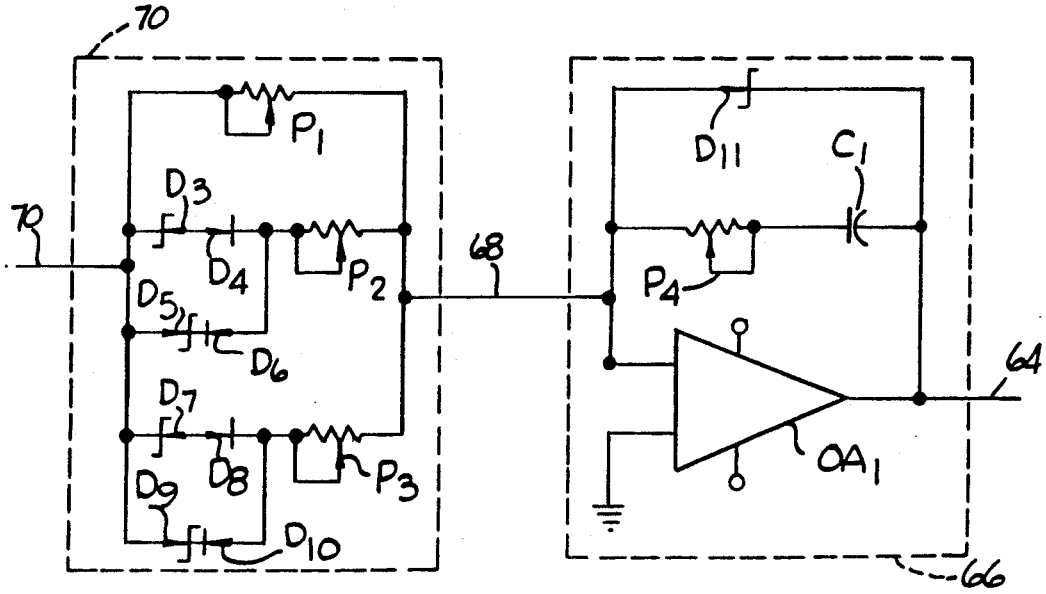
FIG. 5 is a circuit diagram of a circuit used for generating a web winder motor velocity signal from a dancer displacement signal.

The circuitry used to produce motor acceleration signal 68 is illustrated in FIG. 5. The circuit comprises a first resistance pot $P_1$ which may be a 1 MΩ-resistance pot; a second resistance pot $P_2$ which may be a 100 Ω-resistance pot; and a third resistance pot $P_3$ which may be a 10 kΩ-resistance pot. The circuit may also comprise a first diode pair $D_3$, $D_4$, a second diode pair $D_5$, $D_6$, a third diode pair $D_7$, $D_8$, and a fourth diode pair $D_9$, $D_{10}$. In one exemplary embodiment, the first diode in each diode pair is a zener diode which conducts at 2 volts, and the second diode in each diode pair is a rectifier diode which conducts at ½ volt and the linear dancer input voltage is equal to the dancer displacement from a centered position as measured in inches, e.g. a dancer displacement of +7.5 inches from a centered position produces a dancer signal 70 voltage of +7.5 volts, and a dancer displacement of −2.5 inches from center produces a dancer signal voltage of −2.5 volts. In this arrangement, the value "A" of signal 68 produced by the nonlinear dancer response circuitry 70 may be represented by the algorithms $$A = x/p_1, \text{ for } -2.5 < x < +2.5;$$

$$A = x/p_1 + (x-2.5)/p_2, \text{ for } -7.5 < x < -2.5 < x < 7.5;$$

and $$A = x/p_1 + (x-2.5)/p_2 + (x-7.5)/P_3, \text{ for } -10 < x < -7.5 \text{ and } 7.5 < x < 10$$

where x is the dancer displacement in inches from a centered position and where $p_1$, $p_2$, and $p_3$ are the resistance in ohms of resistance pots $p_1$, $p_2$, and $p_3$, respectively.

The signal 68 produced by nonlinear dancer response circuitry 70 is thereafter integrated with respect to time by integrator circuit 66. Integrator circuit 66 comprises a zenor diode $D_{11}$ which in the exemplary embodiment conducts current at a voltage value about 10 volts. The circuit further comprises a resistor pot $P_4$ which may have a resistance of 100 KΩ, a capacitor $C_1$ which may have a capacitance of 10 μfd, and an operational amplifier $OA_1$which may be a general purpose op amp such as the LM741C, produced by National Semiconductor Corp., 2900 Semiconductor Drive, Santa Clara, Calif. This circuit integrates signal 68 over time producing integrated signal 64 which is the velocity command signal to DC motor 62, i.e. DC motor 62 responds to signal 64 by operating at a velocity which is directly proportional to signal 64. Although DC drive motor 62 takes a short period of time to accelerate, the power of the motor is such that the motor response with respect to the speed signal may be considered to be instantaneous. In one preferred embodiment of the invention, the DC motor 62 comprises a model 40 hp, 289 AT2 frame 1750 rpm, manufactured by Emerson Electric Company having a business address of 3036 Alt Boulevard, Grand Island, N.Y., 14072. The typical range of speed control of such a motor over a range of 500 volts is between 0 and 1750 rpm. The construction of nonlinear dancer response circuitry 30 and integrator circuit 26 may be identical to that shown at 70 and 66, respectively, in FIG. 5 with the difference that the linear dancer input signal is inverted by a signal inverter (not shown) prior to being received by nonlinear dancer response circuitry 30 or, alternatively, the signal output 24 of the integrator circuitry 26 may be inverted prior to being applied as a velocity command signal to drive motor 22.

In an alternative embodiment of the invention as illustrated in phantom in FIG. 3, a web speed monitoring device 90 monitors web speed at a position downstream from dancer 36 and generates a web speed voltage signal 92 which is linearly proportionate to web speed. Web speed signal 92 is provided as an input to a divider chip 94 which also receives signal 24 as an input thereto. The divider chip 94 divides the speed signal 92 by signal 24. Signal 24 is proportionate to the web diameter which is wound about spool 14.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Apparatus for controlling the rotational speed of a spool having a web of material wound thereon comprising:

dancer means in contact with a portion of said web of material between said spool and an operating station;

mounting means for mounting said dancer means for movement in linear directions in response to the tension in said portion of said web of material;

dancer signal generating means for generating a dancer signal which has an intensity that is proportionate to the amount of displacement of said dancer means from a center position;

control signal generating means having at least a first electric circuit and a second electric circuit;

said first electric circuit being responsive to at least a portion of all intensities of said dancer signal;

said second electric circuit being response to intensities of said dancer signal above a first predetermined intensity;

said first electric circuit generating a first control signal and said second electric circuit generating a second control signal;

said first control signal having an intensity that varies in response to said dancer signal along a first linear direction having a predetermined slope and said second control signal having an intensity that varies in response to said dance signal along at least a second linear direction having a slope greater than said predetermined slope; and said first or said second control signal controlling the rotational speed of said spool.

2. Apparatus as in claim 1 and further comprising:

said control signal generating means having at least a third electric circuit which is responsive to intensities of said dancer signal above a second predetermined intensity for generating a third control signal;

said third control signal having an intensity that varies in response to said dancer signal in at least a third linear direction having a slope greater than said slope of said second linear direction; and said third control signal controlling the rotational speed of said spool.

3. Apparatus as in claim 1 wherein said control signal generating means comprise:

a first electric circuit for producing an electric signal; and at least a second electric circuit for producing an electric signal which is greater than that produced by said first electric circuit.

4. Apparatus as in claim 3 and further comprising:

at least a third electric circuit for producing an electrical signal which is greater than that produced by said second electric circuit.

5. Apparatus as in claim 1 wherein:

said first electric circuit has a first resistance pot for processing all of said dancer signals; and said second electric circuit has as second resistance pot for processing at least a portion of said dancer signal when said dancer signal is above said first predetermined intensity.

6. Apparatus as in claim 5 wherein:

said first resistance pot has a resistance value that is at least five times greater than the resistance value of said second resistance pot.

7. Apparatus as in claim 5 and further comprising:

said control signal generating means having at least a third electric circuit which is responsive to intensities of said dancer signal above a second predetermined intensity for generating a third control signal;

said third control signal having an intensity that varies in response to said dancer signal in at least a third linear direction having a slope greater than said slope of said second linear direction;

said third electric circuit having a third resistance pot for processing at least a portion of said dancer signal when said dancer signal is above said second predetermined intensity; and said third control signal controlling he rotational speed of said spool.

8. Apparatus as in claim 7 wherein:

said second resistance pot has a resistance value that is at least five times greater than the resistance value of said third resistance pot.

9. Apparatus as in claim 5 and further comprising:

web speed monitoring means for measuring web speed at a position spaced from said dancer means and for generating a web speed signal indicative of said measurement; and electrical processing means for processing said control signal and said web sped signal to produce a resultant signal.

10. Apparatus as in claim 1 and further comprising:

control means for controlling the length of each of said first and second linear directions.

11. Apparatus as in claim 10 and wherein said control signal varies in at least a third linear direction having a slope greater than said slope of said second linear direction.

12. Apparatus as in claim 10 wherein said control signal generating means comprise:

a first electric circuit for producing an electric signal; and at least a second electric circuit for producing an electric signal which is greater than that produced by said first electric circuit.

13. Apparatus as in claim 12 and further comprising:

at least a third electric circuit for producing an electrical signal which is greater than that produced by said second electric circuit.

14. Apparatus as in claim 10 wherein said control signal generating means comprise:

a first electric circuit having a first resistance pot for processing all of said dancer signal; and at least a second electric circuit having a second resistance pot for processing at least a portion of said dancer signal when said dancer signal is above said first predetermined intensity.

15. Apparatus as in claim 14 wherein:

said first resistance pot has a resistance value that is at least five times greater than the resistance value of said second resistance pot.

16. Apparatus as in claim 14 and further comprising:

at least a third electric circuit having a third resistance pot for processing at least a portion of said dancer signal when said dancer signal is above said second predetermined intensity.

17. Apparatus as in claim 16 wherein:

said second resistance pot having a resistance value that is at least five times greater than the resistance value of said third resistance pot.

18. Apparatus as in claim 10 further comprising:

web speed monitoring means for measuring web speed at a position spaced from said dancer means and for generating a web speed signal indicative of said measurement; and electrical processing means for processing said control signal and said web speed signal to produce a resultant signal.

* * * * *